US011788374B2

(12) United States Patent
Gallagher et al.

(10) Patent No.: US 11,788,374 B2
(45) Date of Patent: Oct. 17, 2023

(54) PRESSURE CONTROL APPARATUS INSERTS

(71) Applicant: Kinetic Pressure Control, Ltd., Houston, TX (US)

(72) Inventors: Billy J. Gallagher, Houston, TX (US); Bobby J. Gallagher, Houston, TX (US); Sean Laird, Houston, TX (US)

(73) Assignee: Kinetic Pressure Control Ltd., Houston, TX (US)

( * ) Notice: Subject to any disclaimer, the term of this patent is extended or adjusted under 35 U.S.C. 154(b) by 0 days.

(21) Appl. No.: 17/642,653

(22) PCT Filed: Oct. 2, 2020

(86) PCT No.: PCT/US2020/054152

§ 371 (c)(1),
(2) Date: Mar. 11, 2022

(87) PCT Pub. No.: WO2021/071759

PCT Pub. Date: Apr. 15, 2021

(65) Prior Publication Data

US 2022/0325594 A1 Oct. 13, 2022

Related U.S. Application Data

(60) Provisional application No. 62/913,033, filed on Oct. 9, 2019.

(51) Int. Cl.
*E21B 29/02* (2006.01)
*E21B 33/06* (2006.01)

(52) U.S. Cl.
CPC ..... *E21B 33/063* (2013.01); *E21B 29/02* (2013.01)

(58) Field of Classification Search
CPC ..... E21B 33/063
USPC ..... 166/85.4
See application file for complete search history.

(56) References Cited

U.S. PATENT DOCUMENTS

| | | | | |
|---|---|---|---|---|
| 4,923,005 | A * | 5/1990 | Laky | E21B 33/076 166/85.3 |
| 5,056,418 | A * | 10/1991 | Granger | E21B 33/062 92/24 |
| 6,454,015 | B1 * | 9/2002 | Armstrong | E21B 29/04 166/85.4 |
| 11,060,373 | B2 * | 7/2021 | Ellison | E21B 33/06 |
| 2008/0135791 | A1 * | 6/2008 | Juda | E21B 33/062 251/1.3 |
| 2019/0203555 | A1 * | 7/2019 | Gallagher | E21B 33/063 |
| 2021/0340842 | A1 * | 11/2021 | Gallagher | E21B 33/063 |

OTHER PUBLICATIONS

Written Opinion, International Application No. PCT/US2020/54152 dated Mar. 10, 2021.

* cited by examiner

*Primary Examiner* — Matthew R Buck
*Assistant Examiner* — Douglas S Wood
(74) *Attorney, Agent, or Firm* — Victor H. Segura

(57) ABSTRACT

A blowout preventer includes a main body having a through bore. A pressure chamber is located adjacent to and transverse to the through bore. A gate is disposed in the pressure chamber. An insert is disposed in the main body and defines an opening therethrough parallel to the through bore. The insert also defines a passage therethrough transverse to the through bore for passage of the gate.

18 Claims, 3 Drawing Sheets

PRESSURE CONTROL APPARATUS INSERTS

CROSS REFERENCE TO RELATED APPLICATIONS

Continuation of International Application No. PCT/US2020/054152 filed on Oct. 2, 2020. Priority is claimed from U.S. Provisional Application No. 62/913,033 filed on Oct. 9, 2019. Both foregoing applications are incorporated herein by reference in their entirety.

BACKGROUND

This disclosure relates to the field of well pressure control apparatus, more particularly blowout preventers (BOPs). More specifically, the disclosure relates to structures for gates used in BOPs.

BOPs for oil and gas wells are used to prevent potentially catastrophic events known as a blowouts, where high well pressures and uncontrolled flow from a subsurface formation into the well can expel tubing (e.g., drill pipe and well casing), tools and drilling fluid out of a well. Blowouts present a serious safety hazard to drilling crews, the drilling rig and the environment, and can be extremely costly. Typically BOPs have "rams" that are opened and closed by actuators. The most common type of actuator is operated hydraulically to push closure elements across a through bore in a BOP housing (itself sealingly coupled to the well) close the well. In some cases, the rams have shears to cut through a drill string or other tool which may be in the well at the time it is necessary to close the BOP.

Pyrotechnic gas pressure operated BOP rams have been proposed. An example of such a pyrotechnic gas pressure operated BOP ram is described in International Application Publication No. WO 2016/176725 filed by Kinetic Pressure Control Limited. The pyrotechnic gas pressure is used to urge a gate to accelerate in a bore, whereby kinetic energy of the gate may be used to shear any devices disposed in a BOP housing through bore, thus closing the BOP. Such rams are referred to as "kinetic" BOP rams. In such kinetic BOP rams, a gate traverses through the BOP housing to shear an object within the through bore and close off the well bore. The housing passage for the gate needs to provide adequate sealing to prevent undesired fluid migration and maintain system integrity.

SUMMARY

One aspect of the present disclosure is a blowout preventer. A blowout preventer according to this aspect includes a main body having a through bore and a pressure chamber adjacent to and transverse to the through bore. A gate is disposed in the pressure chamber. An insert is disposed in the main body and defines an opening therethrough parallel to the through bore. The insert also defines a passage therethrough transverse to the through bore for passage of the gate.

In some embodiments, the insert is formed from a first segment and a second segment.

In some embodiments, at least one spreader is disposed between the first segment and the second segment. The at least one spreader comprises means for adjusting a distance between the first segment and the second segment.

In some embodiments, the at least one spreader comprises a first component and a second component each having tapered ends. An end piece is disposed between the first component and the second component at each longitudinal end of the first component and the second component. Each end piece comprises tapered surfaces cooperatively engaged with the tapered ends. An adjuster screw is engaged with the end pieces to change a distance between the end pieces by rotation of the adjuster screw.

In some embodiments, one of the end pieces comprises a hole for through passage of the adjuster screw and another of the end pieces comprises a threaded opening for threadedly engaging the adjuster screw.

Some embodiments further comprise a seal disposed in a surface of the first segment and a seal disposed in a surface of the second segment of the insert to engage an interior surface of the main body surrounding the through bore.

Some embodiments further comprise a seal at each longitudinal end of the insert to engage an interior bore surface of the main body.

Some embodiments further comprise a ring cutter disposed in the insert passage.

In some embodiments, the ring cutter comprises seals arranged to seal the through bore from the passage.

Some embodiments further comprise a spreader on each lateral side and between the first segment and the second segment.

Some embodiments further comprise a propellant charge disposed proximate and end of the pressure chamber.

A method for closing a blowout preventer according to another aspect of this disclosure includes accelerating a gate disposed in a pressure chamber adjacent to a blowout preventer main body having a through bore. The pressure chamber is transverse to the through bore. The gate is moved into a passage transverse to the through bore defined by an insert disposed in the main body. The insert defines an opening through the insert parallel to the through bore.

In some embodiments, the insert is formed from a first segment and a second segment.

In some embodiments, a spreader is disposed between the first segment and the second segment of the insert to maintain a set distance between the first segment and second segment.

In some embodiments, the spreader comprises a first component and a second component each having tapered ends. An end piece is disposed between the first component and the second component at each longitudinal end of the first component and the second component. Each end piece comprises tapered surfaces cooperatively engaged with the tapered ends. An adjuster screw is engaged with the end pieces to change a distance between the end pieces by rotation of the adjuster screw.

Some embodiments further comprise causing the gate to move a ring cutter disposed in the passage about the opening.

Some embodiments further comprise decelerating the gate after it is moved into the insert passage.

In some embodiments, the accelerating the gate is performed by actuating a propellant charge.

In some embodiments, the moving the gate comprises disposing the gate across the through bore.

Other aspects and possible advantages will be apparent from the following description and claims.

DETAILED DESCRIPTION

Figure 1:
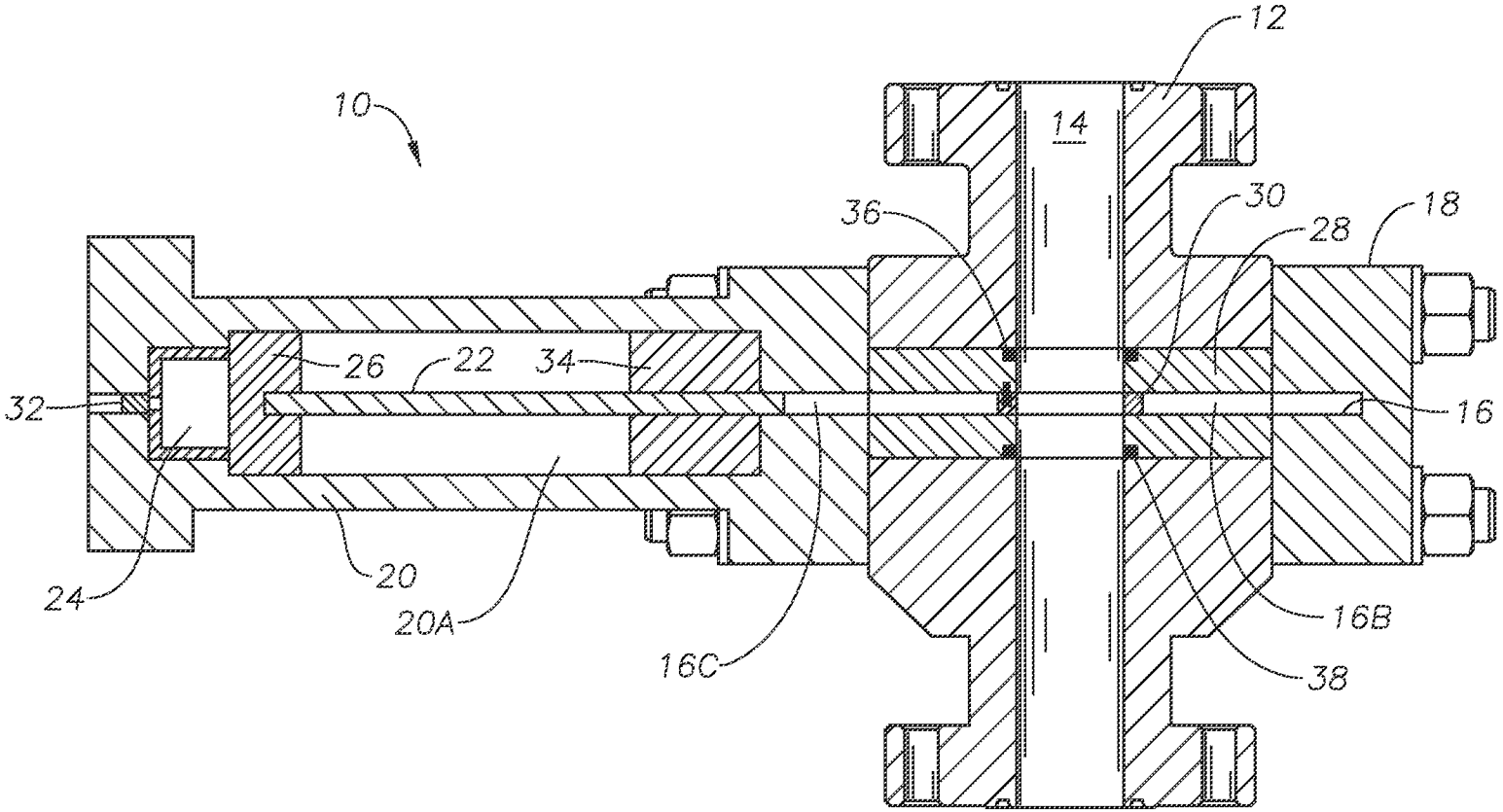
FIG. 1 shows a pyrotechnic gas pressure operated blowout preventer (BOP).

Illustrative embodiments are disclosed herein. In the interest of clarity, not all features of an actual implementation are described. In the development of any such actual implementation, numerous implementation-specific decisions may need to be made to obtain design-specific goals, which may vary from one implementation to another. It will be appreciated that such a development effort, while possibly complex and time-consuming, would nevertheless be a routine undertaking for persons of ordinary skill in the art having the benefit of this disclosure. The disclosed embodiments are not to be limited to the precise arrangements and configurations shown in the figures, in which like reference numerals may identify like elements. Also, the figures are not necessarily drawn to scale, and certain features may be shown exaggerated in scale or in generalized or schematic form, in the interest of clarity and conciseness.

FIG. 1 shows a pyrotechnic gas pressure operated BOP 10, referred to as a "kinetic" BOP. The general structure of the kinetic BOP 10 may be made from steel or similar high strength material. The kinetic BOP 10 comprises a main body 12 having a through bore 14. The main body 12 may be coupled to a wellhead, another BOP (kinetic or other type) or a similar structure (not shown in the figures), so that flow via the through bore 14 may be closed off by operating the kinetic BOP 10. A passageway 16 is formed in a receiving cover 18 coupled to one side of the main body 12. The main body 12 may comprise a part 16B of the passageway adjacent to the passageway 16 in the receiving cover 18. A further part 16C of the passageway may be formed in a housing 20 defining a pressure chamber 20A, adjacent to an opposed side of the main body 12. The embodiment shown in FIG. 1 has a separate housing for the pressure chamber, however, such structure is not a limit on the scope of the disclosure. The main body 12 may be shaped to define a pressure chamber in a unitary structure. The passageway 16 and its parts 16B, 16C provide a travel path for a gate 22. The travel path enables the gate 22 to attain sufficient velocity resulting from actuation of a pyrotechnic charge 24 and subsequent gas expansion against a piston 26 such that kinetic energy in the gate 22 may be sufficient to sever any device disposed in the through bore 14 and to enable the gate 22 to extend into the passageway 16 across the through bore 14.

An insert 28 may provide effective flow closure between the through bore 14 and the passageway 16 and its parts 16B, 16C such that fluid pressure in the through bore 14 is excluded from the passageway 16 and its parts 16B, 16C thereof. A ring cutter 30 may be positioned in the part 16B of the passageway 16. The ring cutter 30 comprises a central opening, which is shown in alignment with the through bore 14 in FIG. 1, and which central opening may comprise one or more geometric features that act to increase the capability of the ring cutter 30 to sever any device in the through bore 14 when the ring cutter 30 is moved by the gate 22. When the gate 22 is disposed across the through bore 14 after actuation of the pyrotechnic charge 24, the through bore 14 is thereby effectively closed to flow across the gate 22. The pyrotechnic charge 24 may be actuated by an initiator 32 of types well known in the art. The piston 26 may be decelerated by an energy absorbing element (brake) 34 such as a crush sleeve or similar device such that the piston 26 does not strike the pressure chamber 20A wall, preventing damage to the pressure chamber 20A or any part of the main body 12 or the receiving cover 18.

Figure 2:
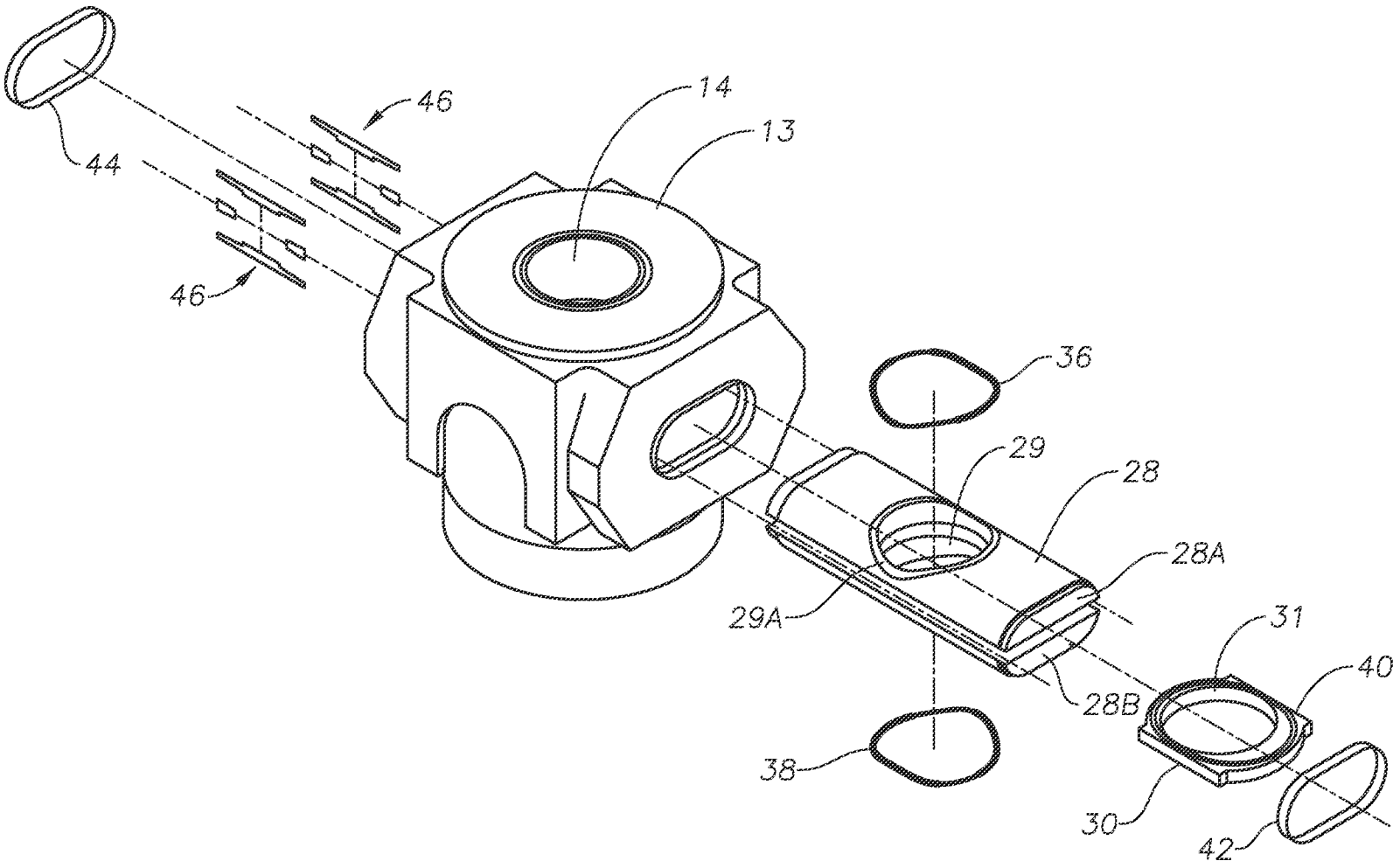
FIG. 2 shows a schematic drawing of a housing with a blow up of an example embodiment of an insert according to the present disclosure.

FIG. 2 shows a schematic of an embodiment of the main body 13 (similar to the main body 12 of FIG. 1) with an expanded view of an example embodiment of an insert 28 according to the disclosure. In FIG. 2, the main body 13 is shown without a receiving cover 18 or pressure chamber 20A (see FIG. 1) for clarity of illustration. The insert 28 may be configured as a modular assembly having a first segment, shown as a first insert segment 28A and a second segment, shown as a second insert segment 28B. The first 28A and second 28B insert segments may be formed from any suitable material, e.g., steel or other high strength metal, and can vary in size and dimensions depending on the dimensions of and the pressure rating of the main body 13 used for the particular embodiment of the BOP as known in the art. Each insert segment 28A, 28B has an opening 29 formed proximate its central region, passing all the way through the insert 28 body. When disposed in the main body 13, the first 28A and second 28B insert segments are positioned such that the respective openings 29 in the insert segments 28A, 28B are aligned with the main body 13 through bore 14 (see FIG. 1). An upper O-ring 36 and a lower O-ring 38 may be respectively positioned in lands 29A formed around the circumference of the openings 29 on the first 28A and second 28B insert segments to provide a fluid seal for the through bore 14 when the insert 28 is mounted within the main body 13.

The ring cutter 30 may be configured in a generally rectangular shape with flat, planar surfaces. An opening 31 is formed in the central region of the ring cutter 30, passing from the top surface through to the bottom surface of the ring cutter 30. In assembly, the ring cutter 30 is disposed between the first 28A and second 28B insert segments. As shown in FIG. 1, when the first 28A and second 28B insert segments are positioned within the main body 13, the two segments 28A, 28B define the passageway 16B. In some embodiments, the ring cutter 30 may be configured with an O-ring 40 disposed on a land formed on its surface surrounding the opening 31. In some embodiments, the ring cutter 30 may be implemented with an O-ring 40 on one surface and another O-ring in a land formed on the opposite surface. Seals 42, 44 may be disposed on each longitudinal end of the insert segments 28A, 28B to provide a fluid seal at the interface between the insert 28 ends and the main body 13.

Figure 3:
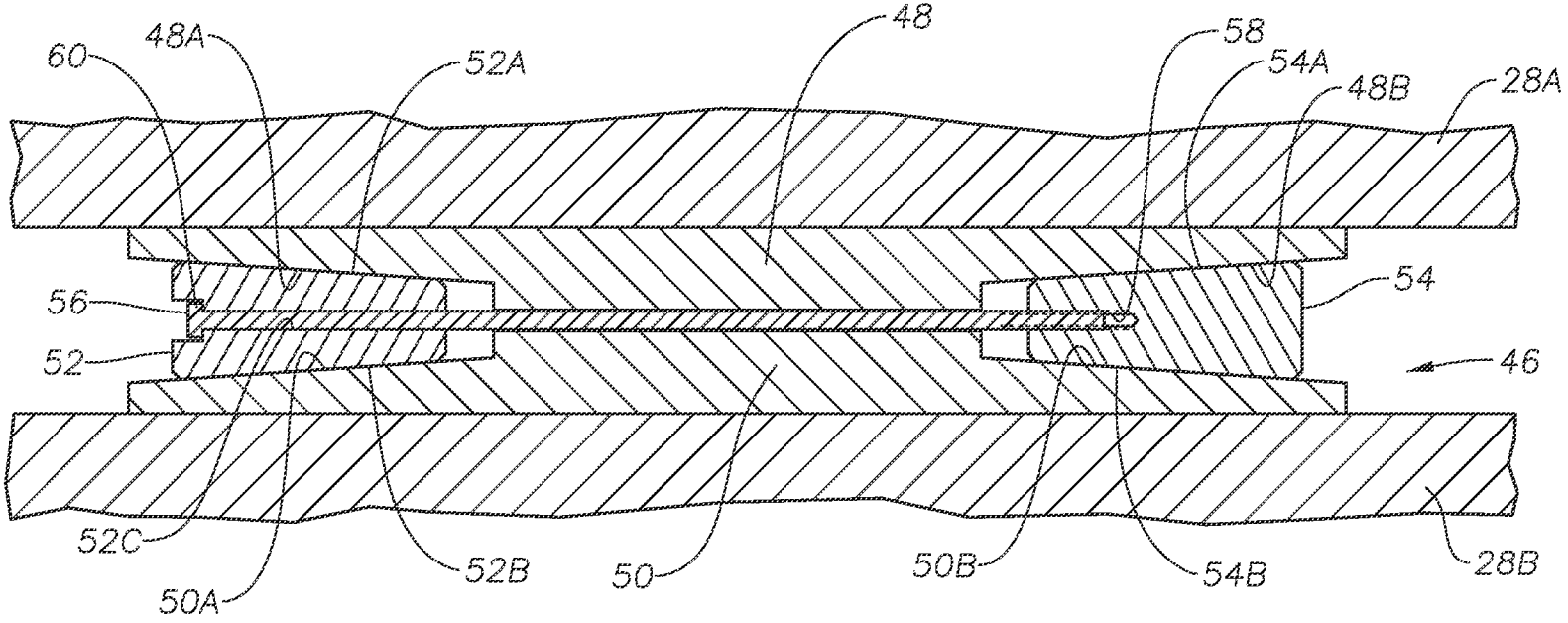
FIG. 3 shows a cutaway side view of a spreader disposed on one side of the insert shown in FIG. 2.

FIG. 2 further shows an exploded view of spreaders 46 that are positioned between the first 28A and second 28B insert segments when the insert 28 is assembled. Both spreaders 46 may be positioned to reside within the passageway 16B, with one spreader disposed on each side of the insert 28. FIG. 3 shows a cutaway side view of one of the spreaders 46 disposed on one side of the insert 28 when the insert 28 is positioned within the main body 13.

An embodiment of the spreaders 46 as shown in FIG. 3 comprises an assembly including a first component 48, a second component 50, a first end piece 52, a second end piece 54, and an adjuster screw 56. As shown in FIG. 3, the first component 48 may be configured with an outwardly (with reference to the center of the first component) tapered first end 48A and an outwardly tapered second end 48B opposite the tapered first end 48A. The first component 48 first and second tapered ends 48A, 48B each form angled ramp surfaces narrowing toward the center of the first bracket 48. The second component 50 may also be configured with an outwardly tapered first end 50A and an outwardly tapered second end 50B opposite the tapered first end 50A. The second component 50 first and second tapered ends 50A, 50B each forming angled ramp surfaces narrowing toward the center of the second component 50. The first end piece 52 may be configured with inwardly tapered sides 52A, 52B, forming a wedge that matches the respective first and second component 48, 50 tapered first ends 48A, 50A. Similarly, the second end piece 54 may be configured with inwardly tapered sides 54A, 54B forming a wedge that matches the respective first and second component 48, 50 tapered second ends 48B, 50B. The adjustment screw 56 extends through a hole 52C in the first end piece 52 to engage with receiving threads 58 formed in the second end piece 54.

When assembled and disposed in the housing 12, 13, each spreader 46 is mounted within the passageway 16B formed between the first and second insert segments 28A, 28B, generally in alignment with the longitudinal axis of the insert 28. The second end piece 54 may be configured with receiving threads 58 to receive the adjustment screw 56 end, as explained above. When the adjuster screw 56 is turned (e.g., with a screwdriver using a slotted screw head 60 or any other combination of screw head and tool, e.g., Phillips, socket head, TORX® head (reg. trademark of Acument Intellectual Properties LLC, Troy, Mich.), to engage with the second end piece 54, the tapered surfaces of the pieces 52, 54 cooperate with the tapered surfaces of the end pieces 54, 56 to force the first and second components 48, 50 to move apart from one another perpendicular to the longitudinal axis of the insert 28. Such movement applies an expanding or spreading force to the first and second insert segments 28A, 28B. As the first and second insert segments 28A, 28B are expanded apart from one another due to the force applied by the first and second components 48, 50, the O-rings 36, 38 on the outer surfaces of the insert segments 28A, 28B are correspondingly pressed against the housing 12, 13 interior surfaces (see FIG. 1), which aids energizing the O-rings 36, 38 to provide a better fluid seal. Once the insert 28 is positioned within the main body (13 in FIG. 2), the adjuster screw 56 may be rotated to cause the spreader 46 to maintain a set distance between the insert segments 28A, 28B.

In light of the principles and example embodiments described and illustrated herein, it will be recognized that the example embodiments can be modified in arrangement and detail without departing from such principles. It will be appreciated by those skilled in the art that embodiments of this disclosure may be implemented using conventional materials, hardware, and components (e.g. suitable conventional seals) as known in the art. Although the foregoing discussion has focused on particular embodiments, any embodiment is freely combinable with any one or more of the other embodiments disclosed herein, and any number of features of different embodiments is combinable with one another, unless indicated otherwise.

What is claimed is:

1. A blowout preventer comprising:

a main body having a through bore;

a pressure chamber adjacent to and transverse to the through bore;

a gate disposed in the pressure chamber;

an insert disposed in the main body and defining an opening therethrough parallel to the through bore and defining a passage therethrough transverse to the through bore for passage of the gate; and at least one spreader disposed between a first segment and a second segment of the insert, the at least one spreader comprising means for adjusting a distance between the first segment and second segment.

2. The blowout preventer of claim 1 wherein the at least one spreader comprises:

a first component and a second component each having tapered ends;

an end piece disposed between the first component and the second component at each longitudinal end of the first and the second component, each end piece comprising tapered surfaces cooperatively engaged with the tapered ends; and an adjuster screw engaged with the end pieces to change a distance between the end pieces by rotation of the adjuster screw.

3. The blowout preventer of claim 1 further comprising a seal disposed in a surface of the first segment and a seal disposed in a surface of the second segment to engage an interior surface of the main body surrounding the through bore.

4. The blowout preventer of claim 1 further comprising a seal at each longitudinal end of the insert to engage an interior bore surface of the main body.

5. The blowout preventer of claim 1 further comprising a ring cutter disposed in the passage.

6. The blowout preventer of claim 1 further comprising a spreader on each lateral side and between the first segment and the second segment of the insert.

7. The blowout preventer of claim 1 further comprising a propellant charge disposed proximate an end of the pressure chamber.

8. A method for closing a blowout preventer, comprising:

accelerating a gate disposed in a pressure chamber adjacent to a blowout preventer main body having a through bore, the pressure chamber transverse to the through bore; and moving the gate into a passage transverse to the through bore defined by an insert disposed in the main body, the insert defining an opening through the insert parallel to the through bore, wherein a spreader is disposed between a first segment and a second segment of the insert to maintain a set distance between the first segment and second segment.

9. The method of claim 8 wherein the spreader comprises:

a first component and a second component each having tapered ends, an end piece disposed between the first component and the second component at each longitudinal end of the first component and the second component, each end piece comprising tapered surfaces cooperatively engaged with the tapered ends, and an adjuster screw engaged with the end pieces to change a distance between the end pieces by rotation of the adjuster screw.

10. The method of claim 8 further comprising causing the gate to move a ring cutter disposed in the passage about the opening.

11. The method of claim 8 further comprising decelerating the gate after it is moved into the passage.

12. The method of claim 8 wherein the accelerating comprises actuating a propellant charge.

13. The method of claim 8 wherein the moving comprises disposing the gate across the through bore.

14. A blowout preventer comprising:

a main body having a through bore;

a pressure chamber adjacent to and transverse to the through bore;

a gate disposed in the pressure chamber;

an insert disposed in the main body and defining an opening therethrough parallel to the through bore and defining a passage therethrough transverse to the through bore for passage of the gate; and a spreader disposed between a first segment and a second segment of the insert to maintain a set distance between the first segment and second segment.

15. The blowout preventer of claim 14 further comprising a ring cutter disposed in the passage.

16. The blowout preventer of claim 14 further comprising a propellant charge disposed proximate an end of the pressure chamber.

17. The blowout preventer of claim 14 further comprising an energy absorbing element disposed in the pressure chamber.

18. The blowout preventer of claim 14 further comprising a piston configured to move the gate in the passage.

* * * * *